US006063020A

United States Patent [19]

Jones et al.

[11] Patent Number: 6,063,020

[45] Date of Patent: May 16, 2000

[54] HEATER DOOR SAFETY INTERLOCK FOR INFANT WARMING APPARATUS

[75] Inventors: Thomas C. Jones, Columbia; Harry E. Belsinger, Jr., Catonsville; Steven M. Falk, Baltimore, all of Md.

[73] Assignee: Datex-Ohmeda, Inc., Tewksbury, Mass.

[21] Appl. No.: 09/316,652

[22] Filed: May 21, 1999

[51] Int. Cl.[7] ..... A61G 11/00

[52] U.S. Cl. ..... 600/22

[58] Field of Search ..... 600/22; 119/300, 119/311, 308, 309, 318, 319

[56] References Cited

U.S. PATENT DOCUMENTS

| | | | |
|---|---|---|---|
| 4,936,824 | 6/1990 | Koch et al. . | |
| 5,453,077 | 9/1995 | Donnelly et al. . | |
| 5,474,517 | 12/1995 | Falk et al. . | |
| 5,649,896 | 7/1997 | Barsky | 600/22 |
| 5,817,003 | 10/1998 | Moll et al. | 600/22 |
| 5,980,449 | 11/1999 | Benson et al. | 600/22 |

*Primary Examiner*—Cary O'Connor
*Assistant Examiner*—Cath McPherson
*Attorney, Agent, or Firm*—Roger M. Rathbun

[57] ABSTRACT

An infant warming apparatus that functions both as an infant incubator as well as an infant warmer. The apparatus has a heater that moves vertically with respect to an infant support during the change in function between an infant incubator and infant warmer. A powered motive system, such as an electric motor, powers the movement of the heater between its upper and its lower positions. The heater also has a door or doors that are open when the heater is in it upper position so that the heater can direct energy toward the infant to warm the infant when acting as an infant warmer. When closed, the doors isolate the heater to prevent the inadvertent touching of the heater by the infant or attending personnel. A safety interlock system is provided that prevents the heater from being activated unless it is in its upper position and the door or doors are fully open. In addition, the interlock system also monitors the downward movement of the heater and discontinues that downward movement if the heater reaches a predetermined position and the door or doors are still in the open position. As a further interlock safety feature, a sensor also senses when the heater has reached its lower position and stops further downward movement of the heater.

17 Claims, 4 Drawing Sheets

HEATER DOOR SAFETY INTERLOCK FOR INFANT WARMING APPARATUS

BACKGROUND

The present invention relates to an infant warming apparatus and, more particularly, to an apparatus for providing the combined functions of an infant incubator and an infant warmer and which includes various safety interlocks as protection to the infant, the attending personnel and the apparatus itself.

There are, of course, many devices or apparatus for the warming of an infant and which supply the necessary heat to maintain the infant at a predetermined temperature. Of the various apparatus, there are infant warmers that are basically planar surfaces on which the infant is positioned and which planar surfaces generally include side guards to keep the infant safely within the confines of the apparatus. Infant warmers normally have an overhead radiant heater that is located above the infant and which thus radiates energy in the infrared spectrum to impinge upon the infant to maintain the infant at a warm, predetermined temperature. Since the infant is otherwise totally exposed to the surroundings, there is almost unlimited access to the infant by the attending personnel to perform various procedures on that infant. At typical infant warmer is shown and described in U.S. Pat. No. 5,474,517 of Falk et al as prior art to that patent.

There are also infant incubators and which are more confined enclosures that contain the infant within an enclosed controlled atmosphere that provides heat to the infant and also may provide control of humidity in the enclosed environment. Such incubators maintain the infant for long periods of time and there are handholes to access the infant and/or a larger door is provided that can be opened to access the infant or to insert or remove the infant to and from the incubator. Such devices provide a good atmosphere to the infant and control that local environment within which the infant is located, however, it is sometimes difficult to perform a wide variety of procedures on the infant due to the somewhat limited access to that infant. A typical infant incubator is shown and described in U.S. Pat. No. 4,936,824 of Koch et al.

At the present, there are also certain infant care apparatus that combine the functions of an infant warmer and an incubator. One such apparatus is shown and described in U.S. Pat. No. 5,453,077 of Donnelly et al and which has an overhead canopy including an infrared heater and the canopy and heater are raisable and lowerable with respect to an infant positioned in the apparatus. Therefore, the device can operate as an incubator when the canopy and heater are in the lowered position and can act as an infant warmer when the canopy and the heater are in the upper position.

One difficulty, however, is in the raising and lowering of the heater. It is important that the infant not be radiantly overheated by exposure to the heater in a position closely proximal to the infant. Such can occur if the heater is lowered to its lower position and the heater as well as other heated surfaces are exposed to the infant. The heated surfaces continue to emit infrared energy and convective energy and, at the close proximity to the infant, can cause harm to that infant from overheating.

In addition, it is important to insure that the infant as well as the attending personnel are not subjected to the possibility of touching any of the heated surfaces of the heater or components that are warmed by contact or close proximity to that heater. Thus, certain safety features are needed to make sure the overhead radiant heater is operated to prevent any inadvertent contact with the radiant heater by the infant or other personnel and further that the apparatus itself is protected against hazardous conditions.

SUMMARY OF THE INVENTION

Accordingly, the present invention relates to an infant care apparatus that combines the functions of an infant care warmer and an incubator but in addition, has a door or doors that can close when the canopy including the radiant heater is lowered toward the infant and open when the canopy and heater are again raised to the upper position.

Thus, it is important to ensure that the doors are fully open when the heater and canopy are in the proper upper position before the heater can be activated and, similarly, it is important to insure that the doors are properly closed before the heater is lowered to any position where it could be contacted by the infant or where the radiant energy from the heater or other surfaces could adversely affect the infant. Therefore the present invention provides various interlocks to make sure that the operation of the apparatus does not present any danger to the infant, the attending personnel and to the apparatus itself.

In carrying out the invention, an interlocking system is provided that insures that the heater cannot operate in an unsafe position, that is, the heater cannot operate unless the doors are in the open position and the heater is at its upper position. Secondly, it is important to ensure that the heater cannot be lowered to a position within the reach of the infant or near the attending personnel unless the doors are safely in the closed position.

The radiant heater is raised and lowered by an automatic motive means, one of such means being a threaded screw that threadedly engages with a movable member on which the heater is mounted. An electric motor preferably operates the threaded screw to cause the heater to be raised and lowered with respect to the infant. The doors are operative by use of a variety of mechanical or electrical means, it only being important that there is some sensor to determine that the doors are in the open position and in the closed position and thus communicate that information to a device such as a central processing unit (CPU) that can take the proper action with respect to the operation of the radiant heater.

Thus, the interlock system insures that the heater cannot be activated unless the doors are open and the heater is in its upper position. The interlock system further interrogates the door closed sensor during the downward travel of the heater at an intermediate predetermined point. If, at that point in its downward travel, the door closed sensor does not indicate that the door or doors are closed, the interlock system immediately stops the further downward movement of the heater at a point where the safety of the infant is assured.

As an alternate embodiment, the interlock system interrogates the door closed sensor at a predetermined point that is determined by timing the downward movement of the heater from a known position and interrogating the door closed sensor when a known period of time has elapsed indicative of the heater reaching a certain point in its downward movement. Thus, there is no intermediate position sensor but instead, an intermediate position is determined by the passage of a known period of time following the commencement of downward movement from a known position, preferably the upper position, and at that elapsed time, the door sensor must be indicating that the doors are closed or further downward movement is terminated.

These and other features and advantages of the present invention will become more readily apparent during the following detailed description taken in conjunction with the drawings herein.

DETAILED DESCRIPTION OF THE INVENTION

Figure 1:
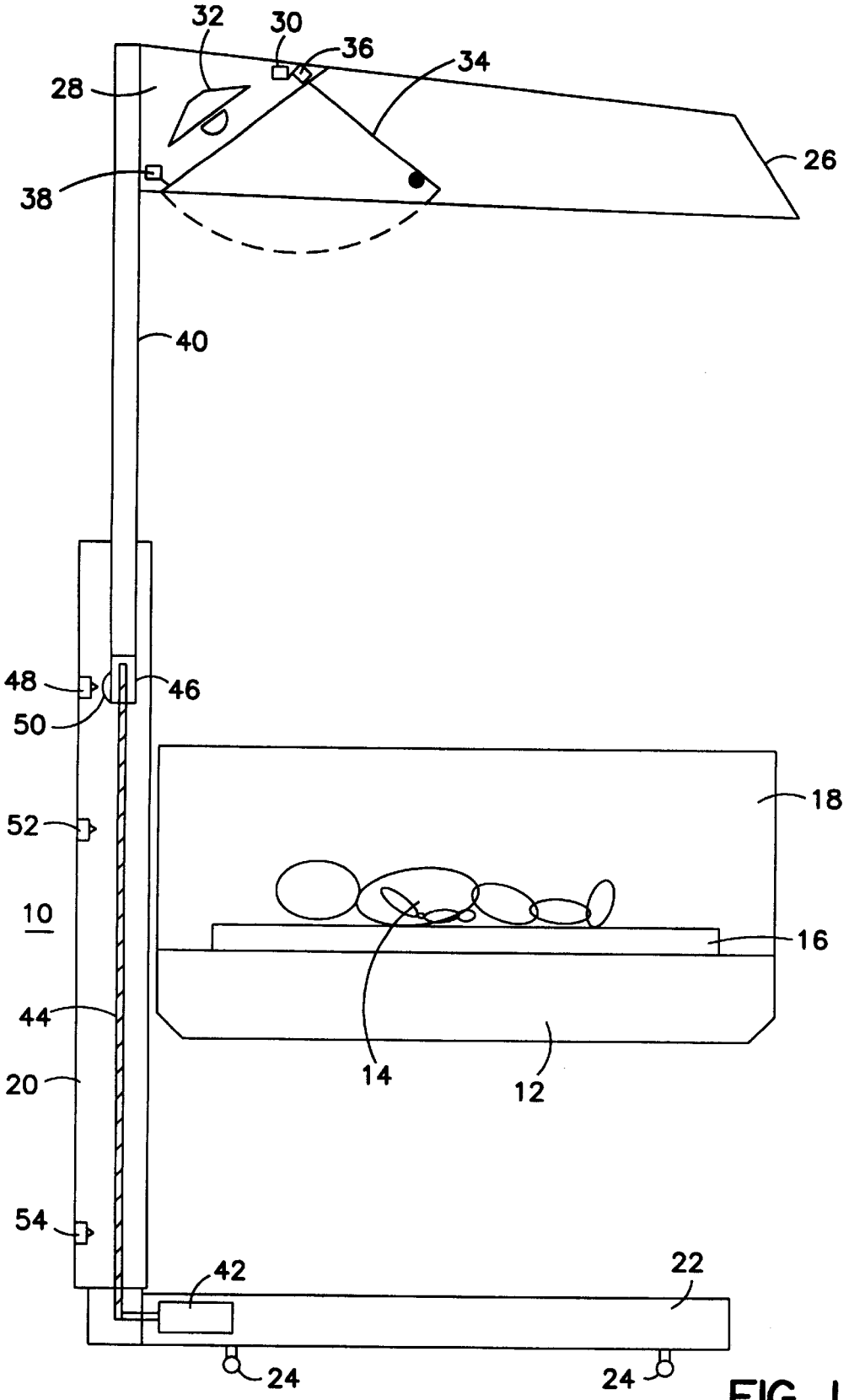
FIG. 1 of a schematic view of the infant warming apparatus constructed in accordance with the present invention wherein the radiant heater is shown in its upper position.

Referring now to FIG. 1, there is shown a schematic view of an infant warming apparatus 10 constructed in accordance with the present invention. As shown the infant warming apparatus 10 includes an infant pedestal 12 that supports and carries an infant 14 for ready access to treatment by attending personnel. An infant mattress 16 is also provided for the comfort of the infant As is also seen, a plurality of walls 18 are provided to contain the infant safely within the infant warming apparatus 10 and may be positioned at all of the four sides of the infant pedestal 12. The walls 18 are preferable constructed of transparent plastic material and, as will be explained, cooperate with other components in order to provide an incubator function to the infant warming apparatus 10.

A vertical member 20 generally supports the pedestal 12 in cantilever fashion and the vertical member 20 may also have a supporting base 22 including wheels 24 to firmly support the infant pedestal 12 as well as the other components of the infant warming apparatus 10.

As also can be seen in FIG. 1, there is a canopy 26 that is positioned above the infant pedestal 12 and which contains a heater housing 28 in turn, containing a heater 32. As shown, in the preferred embodiment, the heater 32 is a radiant heater and, in the position of the heater housing 28 as shown in FIG. 1, the heater 32 directs infrared energy downwardly to impinge upon the infant 14 to maintain that infant at an elevated temperature. It can be seen, however, that various other types of heaters can be used, including the infrared emitter shown and described in U.S. Pat. No. 5,474,517 of Falk et al.

In any event, the heater housing 28 also includes a door means and, as shown, that door means comprises at least one movable door 34 that can be moved between an open position where the heater 32 is open to the surrounding environment and a closed position where the heater 32 is isolated and thus protected from the surrounding environment and is contained within the heater housing 28. As shown in FIG. 1, there is only one door for illustrative purposes, however, it can readily be seen that there can be any number of doors in various configurations; it only being important that the door means shield the heater 32 from the surroundings when in the closed position and expose the heater 32 for use in providing infrared energy toward the pedestal 12 when in the open position.

The operation of the door may be by a variety of means, including mechanical means as shown and described in a U.S. patent application entitled Heater Door Mechanism for Infant Warming Apparatus and filed on the same day as the present application and the disclosure of which is incorporated herein by reference. For simplicity, however, the movable door can be illustrated as openable and closable by means of a stepper motor 30 mounted internal of the heater housing 28 and which is easily controlled by suitable means to move the door or doors to their open and closed positions.

A sensing mean is provided to detect when the movable door 34 is in the fully open and the fully closed positions. The sensing means may be a single sensor that detects the position of the door or, alternately, it may be a door open sensor and a door closed sensor as shown in the Figures as door open sensor 36 and door closed sensor 38 that can be micro-switches, limit switches, interrupting of a light beam or any other mechanism that determines the position of the door and provides a signal indicative of that position. By open and closed positions, it can be noted that the door may, if desired, be sensed when it is substantially open or substantially closed, again providing when the door is in the closed or substantially closed position, the heater 32 is isolated from being contacted by the infant or the attending personnel.

As indicated, the canopy 26 along with the heater 32 moves vertically with respect to the infant pedestal 12 and in FIG. 1, it is shown in its upper position. Although the actual raising and lowering of the canopy 26 may be by a variety of means, in the Figure, the embodiment comprises a vertical moving member 40 that supports canopy 26 in cantilever fashion. The vertical moving member 40 is raised and lowered by means of an electrically operated motive means and one such motive means can be through the use of an electric motor 42 that is operated by a control system, controlled by the user or by an automatic system, that rotates in a controlled manner, a threaded screw 44 by a gear train that in turn, is threadedly engaged to a threaded lug 46 fixed to the moving member 40. Accordingly, as the electric motor 42 rotates in either direction, the moving member 40 is caused to raise and lower to change the vertical position of the canopy 26 and, of course, the heater 32 correspondingly is raised and lowered.

An upper sensor 48 is positioned along the vertical member 20 and again, may be any of wide variety of position sensors. In the embodiment shown in FIG. 1, the upper sensor 48 is shown as a limit switch, micro-switch or the like and which is activated by an actuator 50 that is fixed to the moving member 40. Thus, upper sensor 48 provides a signal that indicates that the canopy 26, and thus the heater 32, is in the upper position and is therefore in a position to safely direct radiant heat to impinge upon the infant 14. As will be seen, in the later FIG. 4, the heater 32 can therefore be activated to provide the radiant heat to the infant 14 providing the upper sensor 48 properly indicates that the heater 32 is in the correct, uppermost position and further, that the door open sensor 36 provides a corresponding indication, by means of a signal, that the movable door 34 is in the open position.

In this manner, in the use of the infant warming apparatus 10, the user is assured that the various components are in their proper positions for activation of the heater 32, that is, the heater 32 is in its upper position and the movable door 34 is in its open position. As will be seen, if either the door open sensor 36 or the upper sensor 48 does not provide the proper signal, the heater 32 is prevented from being activated.

Therefore, in the FIG. 1 position, in order for the heater 32 to be activated, the heater 32 must be in its upper position and the movable door 34 must be in its open position thereby providing a safety system to assure proper operation of the infant warming apparatus.

In addition to the foregoing safety interlock system, the activation of the upper sensor 48 also causes the motive means, in this case the electric motor 42 to be deactivated, since the heater 32 has reached its upper position.

Figure 2:
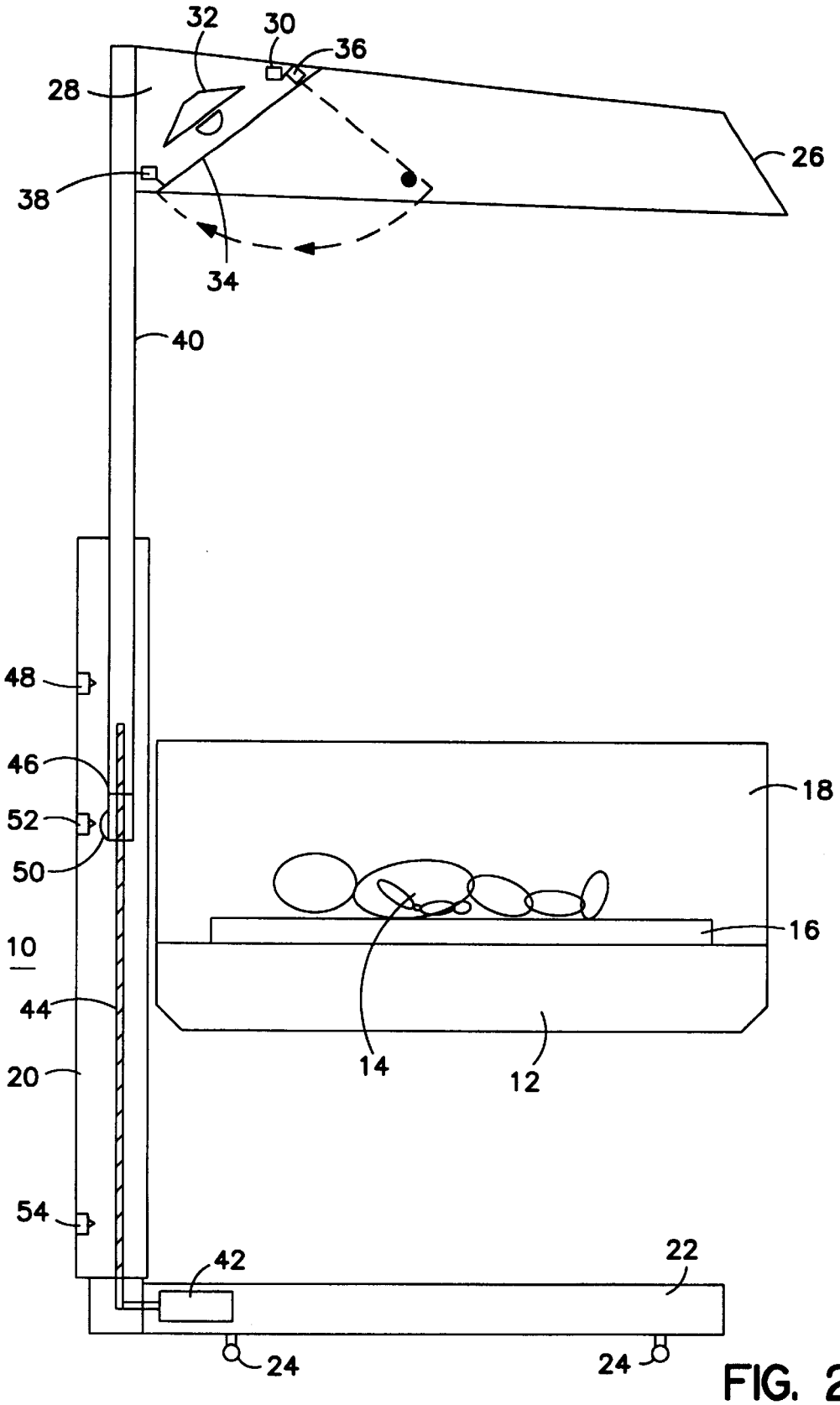
FIG. 2 is a schematic view of the apparatus of FIG. 1 but showing the radiant heater in an intermediate position.
Figure 3:
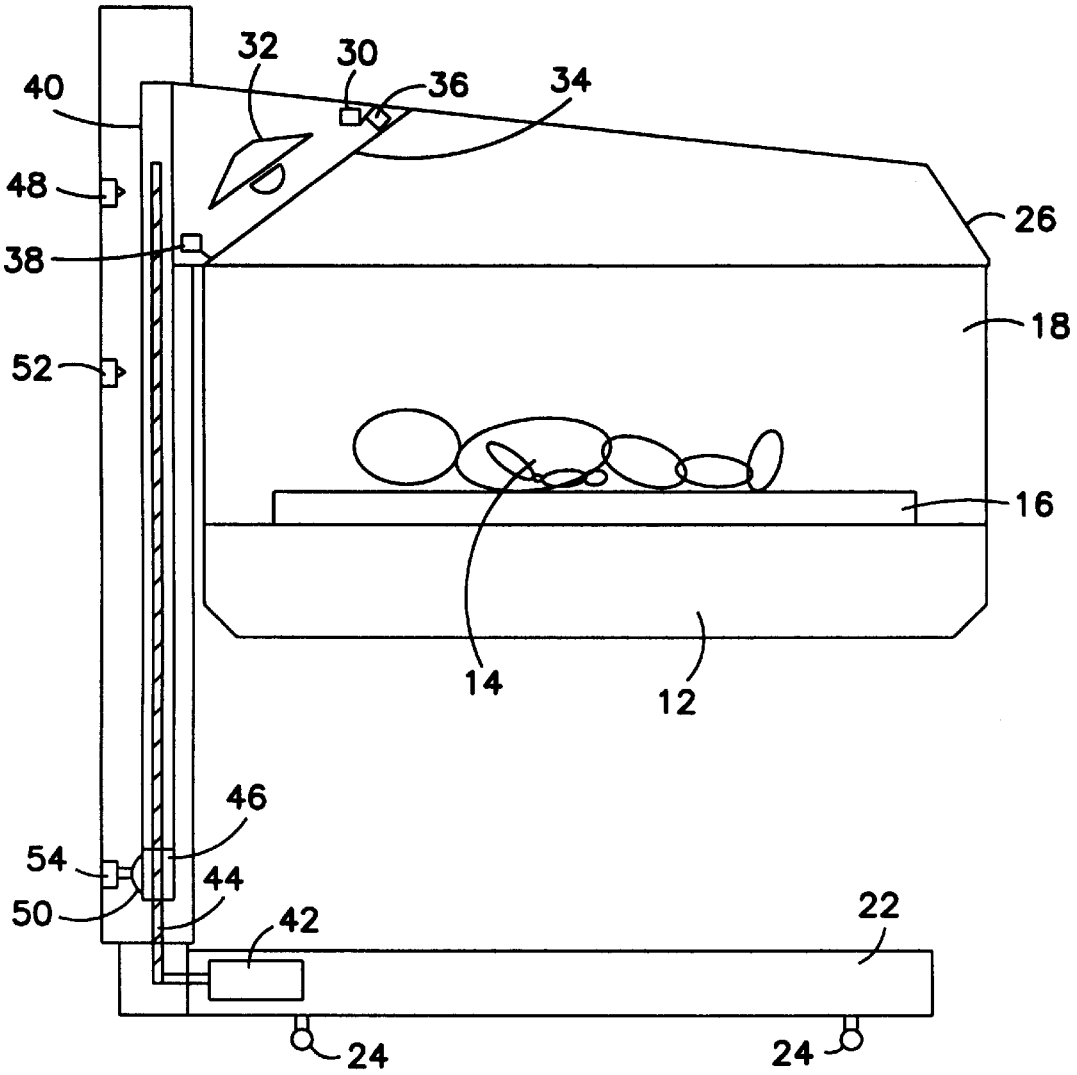
FIG. 3 is a schematic view the apparatus of FIG. 1 showing the radiant heater in its lower position.

Turning now to FIG. 2, there is shown a schematic view of the infant warming apparatus of the present invention and where the heater 32 is located in an intermediate position, that is at some point between its upper position shown in FIG. 1 and its lower position as shown in FIG. 3. In this Figure, there is an intermediate sensor 52 that is activated by the actuator 50. The movable door 34 is shown to have moved from the dotted line position in the direction of the arrows A to the closed, solid line, position and thus activating the door closed sensor 38 and deactivating the door open sensor 36.

In the event the user, or by an automatic control, commences to move the heater 32 to its lower position, the heater 32 proceeds to move vertically downwardly by means of the motive means and during that downward travel reaches an intermediate position that activates the intermediate sensor 52 illustrated in the position of FIG. 2. Again, as will be explained with respect to FIG. 4, the control system receives a signal from the intermediate sensor 52 indicating that the heater 32 has moved a certain distance downwardly and is at the predetermined intermediate position. Upon receipt of that signal from the intermediate sensor 52, the control system seeks to interrogate and look for a signal from the door closed sensor 38.

As an alternate means of determining the intermediate position, there can be a timer, not shown in FIG. 2, that is started when the heater 32 commences its downward movement from a known position. Preferable that position is the upper position such that the timer is activated as soon as the heater 32 is caused to move downwardly from that upper position. Since the speed of the heater 32 is known as a function of the motor speed, gearing and the like, it is a relatively easy matter to determine, on a temporal basis, the amount of time that will elapse before the heater 32 will move from its upper position to an intermediate position that is the predetermined position and where the door closed sensor 38 is interrogated to verify that the door 34 is in the closed position.

In any event, if the closed door sensor 38 provides the proper signal, that is, indicating that the movable door 34 is in its closed position, the control system takes no action and the motive means can continue to lower the heater 32. If, on the other hand, upon the activation of the intermediate sensor 52, or passage of the predetermined elapsed time, there is no corresponding signal from the door closed sensor 38, the control system concludes that the movable door 34 is not properly closed. Thus, continuing to lower the heater 32 could allow the heater 32 in its door open position to reach a point too close to the infant or to the attending personnel for adequate safety.

Accordingly when such condition exists, the control system immediately deactivates the motive means by shutting down the electric motor 42 to prevent the heater 32 from continuing its downward movement. In the design of the location of the predetermined intermediate point i.e. the position of the intermediate sensor 52 or the passage of the elapsed time, that intermediate point is predetermined such that the heater 32 is still far enough away from the infant 14 and the surrounding personnel so as to be safe from being inadvertently touched by any party.

Turning now to FIG. 3, there is shown a schematic view of the infant warming apparatus 10 of the present invention with the heater 32 in its lower position. As can be seen in this Figure, the canopy 26 covers and overlies the upstanding edges of the walls 18 and the infant 14 is enclosed in an incubator environment where the heat and humidity can be readily controlled by separate and conventional heating means. In this lower position, a lower sensor 54 is activated by the actuator 50 to deactivate the motive means to prevent it from further rotating the threaded screw 44. Thus, the further travel of the heater 32 in the downward direction is terminated.

Figure 4:
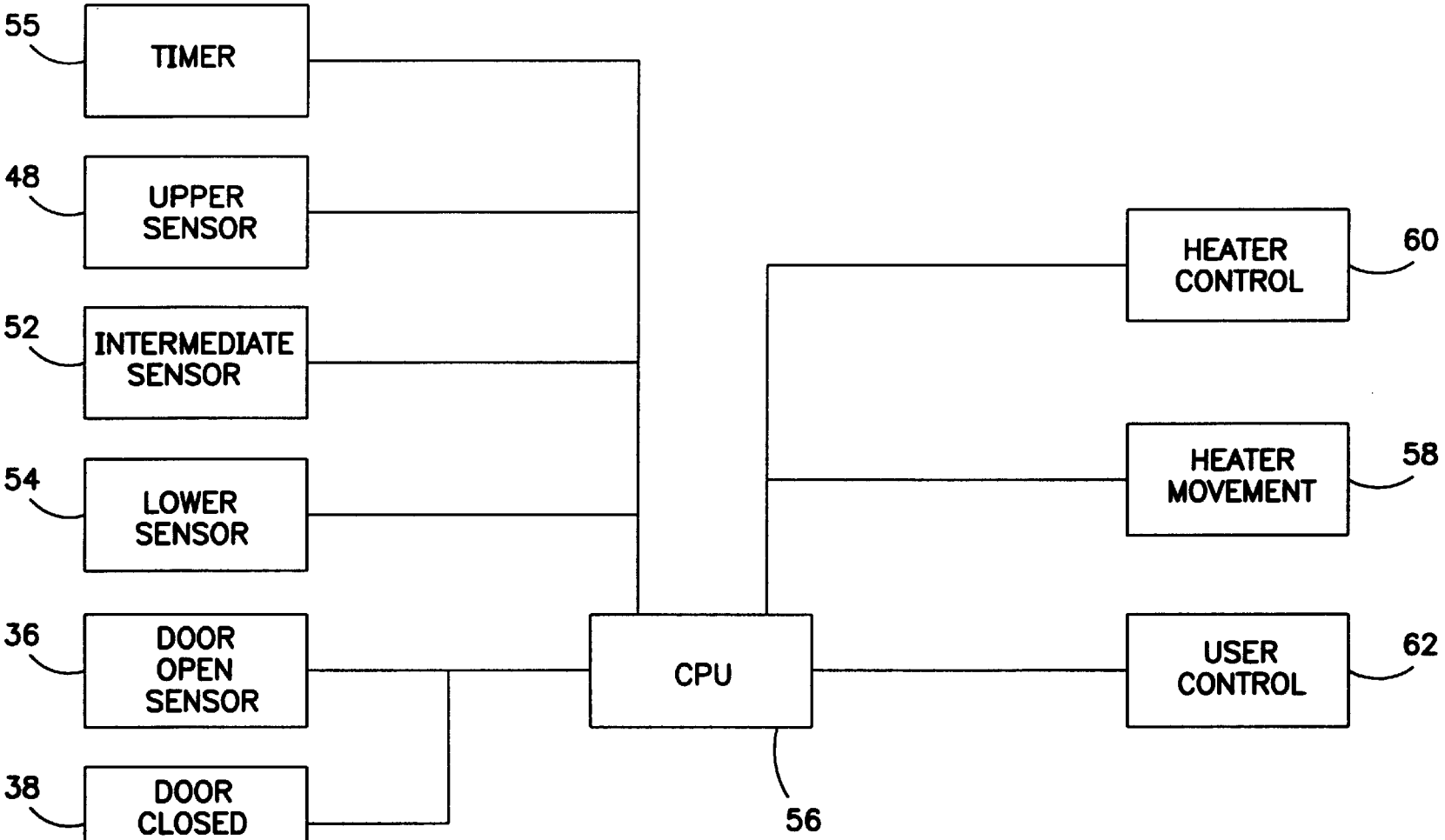
FIG. 4 is a block diagram of a typical control system usable with the present invention.

Turning finally to FIG. 4, there is shown a block diagram of a typical control system for providing the interlock features of the present invention. As can also be seen, a controller 56 is used and which may be a central processing unit and its duties shared with other features and functions of the infant care apparatus. The controller receives signals from each of the upper sensor 48, the intermediate sensor 52, the lower sensor 54 and the timer 55 and, upon receipt of certain of the signals from those sensors, controls the motive means, shown as the heater movement 58, and also controls the heat energy from the heater shown as heater control 60 by controlling the electric energy to the heater itself.

In addition, as shown, there is an open door sensor 36 and a door closed sensor 38 that provide signals to controller 56 indicative of the position of the door, that is, whether it is in the open or the closed position. Further, an input to the controller 56 is provided by a user control 62 that allows the user to enter certain instructions to the controller 56 requesting the infant heating apparatus to carry out certain functions.

As may now be seen with respect to the control scheme, and take, for example, the situation where the heater has been raised to its upper position and the user therefore desires to activate the heater to provide infrared energy to the infant. The user can provide an input to the controller 56 by means of the user control 62 to activate the heater. The controller receives the signal from the user control 62 but does not activate the heater until controller 56 first interrogates the upper sensor 48 and determines that the heater is in its upper position and further interrogates the door open sensor 36 to confirm that the door is in the open position. If either of the signals is missing, indicating that either the door is not open or the heater is not in its upper position, the controller 56 refuses to send the heater activation signal to the heater control 60 and thus, the heater is not activated.

In a further scenario, that is when the user desires the heater to be lowered from its upper position to its lower position, the user again provides a signal to the controller 56 requesting such action by means of the user control 62. The controller 56 signals the heater movement 58 to cause the motive means to lower the heater toward its lower position, however, when the heater reaches a predetermined intermediate position, the intermediate sensor 52 signals the controller 56 that such point has been reached by the heater in its downward travel and the controller 56 immediately interrogates the door closed sensor 38 to make sure the door is safely in its closed position. In the event the interrogation indicates that no signal has been received from the door closed sensor 38, the controller 56 communicates with the heater movement 58 and stops the further downward movement of the heater, thus preventing the heater from reaching a position where it could be inadvertently touched by the infant or by attending personnel.

Again, as an alternate to the intermediate sensor 52, the system can make use of the timer 55 to determine when the heater has reached the desired intermediate position. By this means, the timer can be activated when the heater commences its downward movement, such as when the operator initiates the motor to move the heater downwardly. At that point, the timer 55 is activated and the timer 55 thereafter measures the elapsed time until a predetermined elapsedtime is reached indicative of the desired intermediate location. Thus, as with the intermediate sensor 52, the door closed sensor 38 is interrogated to see if the door is in its closed position. If it is, the heater continues downwardly. If the door is not closed, the controller 56 again stops the further downward movement of the heater by sending the appropriate signal to the heater movement 58 to terminate further downward movement.

Finally, in a further scenario, when the heater has been lowered to its lower position, the lower sensor 54 is activated by actuator 50 to send a signal to the controller 56 indicative of the heater reaching its lower position. The controller 56 then communicates with the heater movement 58 to inactivate the motive means and terminate any further downward movement of the heater and the canopy.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

We claim:

1. An infant care apparatus, said apparatus having a surface on which an infant is positioned, a vertical member having mounted thereon a housing including a heater movable along said vertical member between a lower position near said surface and an upper position, said housing having at least one door movable between an open position wherein said heater is exposed and a closed position wherein said heater is confined within said housing, door actuator means operable to move said at least one door between said open and said closed positions, motive means to raise and lower said housing between said upper and lower positions, the improvement comprising a first sensor to sense said closed position of said at least one door, a second sensor adapted to sense the location of said housing at a predetermined position intermediate said upper and said lower positions, and a control means adapted to receive signals from said first and second sensors to control said motive means to terminate the further movement of said housing toward said lower position when said at least one door is not in said closed position.

2. An infant care apparatus as defined in claim 1 wherein said at least one door comprises two doors pivotally affixed to said housing.

3. An infant care apparatus as defined in claim 1 wherein said second sensor comprises a timer adapted to measure a predetermined elapsed time to sense said predetermined position intermediate said upper and lower positions.

4. An infant care apparatus as defined in claim 1 wherein said second sensor is a position sensor that determines said predetermined position intermediate said upper and lower positions.

5. An infant care apparatus, said apparatus comprising a base, an infant platform supported on said base and adapted to support an infant on said platform, a heater mounted above said platform, said heater being movable between a lower position where said heater is near said infant platform to an upper position, motive means adapted to move said heater from said upper position to said lower position, a controller for controlling the movement of said heater, said heater having at least one door movable between an open position and closed position wherein said heater is contained in a protective environment, a closed door sensor adapted to sense when said door is in said closed position and to provide a signal indicative of said closed position to said controller, a position sensor adapted to determine when said heater has reached a predetermined position in moving downwardly and to provide a signal indicative of said position, said controller adapted to terminate the downward movement of said heater upon receipt of said signal from said position sensor when said signal from said closed door sensor is not also received.

6. An infant care apparatus as defined in claim 5 wherein said controller is a central processing unit.

7. An infant care apparatus as defined in claim 5 wherein said position sensor comprises a timer adapted to measure an elapsed time between the commencement of downward movement of said heater from a known point and the time when the heater reaches said predetermined position.

8. A method of providing safety in an infant apparatus, said method comprising:

a. providing an infant platform for supporting an infant;

b. providing a heater above the infant platform that can be raised and lowered between an upper and a lower position, c. providing a door to shield said heater having an open and a closed position;

d. lowering the heater from said upper position toward the lower position;

e. sensing the position of the door when in the closed position f. sensing a predetermined position of the heater during the downward movement of the heater, and g. preventing further downward travel of the heater at or near the predetermined position in response to the sensed position in step (f) unless the sensing step of step (e) senses said door is in the closed position.

9. A method of providing safety in an infant apparatus as defined in claim 8 wherein said step of sensing a predetermined position of the heater during the downward movement comprises measuring a predetermined elapsed time following the commencement of downward movement of the heater.

10. A method of providing safety in an infant apparatus as defined in claim 8 wherein said step of sensing a predetermined position of the heater during the downward movement comprises locating a position sensor along the path of movement of the heater.

11. An infant care apparatus, said apparatus comprising a base, an infant platform supported on said base and adapted to support an infant on said platform, a heater mounted above said platform, said heater being movable between a lower position where said heater is near said infant platform to an upper position, motive means adapted to move said heater from said lower position to said upper position, a controller for controlling the activation and deactivation of said heater, said heater having at least one door movable between an open position wherein said heater can direct infrared energy toward said infant platform and a closed position wherein said heater is contained in a protective environment, an open door sensor adapted to sense when said door is in said open position and to provide a signal indicative of said open position to said controller, a position sensor adapted to determine when said heater is in said upper position, said controller activating said heater when signals are sensed from said position sensor and said open door sensor.

12. An infant care apparatus as defined in claim 11 wherein said at least one door comprises two doors.

13. An infant care apparatus as defined in claim 12 wherein said controller comprises a central processing unit.

14. An infant care apparatus as defined in claim 11 wherein said heater is an infrared radiant heater directing infrared energy to impinge upon an infant resting on said platform.

15. An infant care apparatus as defined in claim 11 wherein said motive means includes an electric motor.

16. A method of activating a radiant heater used with an infant care apparatus, said method comprising:

a. providing an infant platform for supporting an infant;

b. providing a heater above the infant platform that can be raised and lowered between an upper and a lower position, c. providing at least one door to shield said heater having an open and a closed position;

d. raising the heater from said lower position to said upper position;

e. sensing the position of the door when in the open position, f. sensing the location of said heater when in said upper position, and g. activating the heater only when position of the door is sensed in step (e) to be in the open position and the location of the heater as sensed in step (f) is sensed to be in its upper position.

17. A method as described in claim 16 wherein said step of providing at least one door to shield said heater comprises providing two doors operable to move between open and closed positions.

* * * * *